US005829911A

United States Patent [19]

Yokota et al.

[11] Patent Number: 5,829,911

[45] Date of Patent: Nov. 3, 1998

[54] METHOD FOR FORMING A HIGH-TOOTH SPLINE OF A HOLLOW SHAFT AND HOLLOW SHAFT HAVING A HIGH-TOOTH SPLINE

[75] Inventors: Norihito Yokota; Hiroyuki Ikuta; Hitoshi Nakai, all of Aichi pref., Japan

[73] Assignees: Aisin Seiki Kabushiki Kaisha, Kariya; Aisin AI Co., Ltd., Nishio, both of Japan

[21] Appl. No.: 752,398

[22] Filed: Nov. 20, 1996

[30] Foreign Application Priority Data

Nov. 20, 1995 [JP] Japan ..... 7-326558

[51] Int. Cl.[6] ..... B21D 22/00; B21D 41/00

[52] U.S. Cl. ..... 403/359; 403/404; 72/359; 72/370.01

[58] Field of Search ..... 403/359, 404, 403/179; 72/359, 370.03, 370.01; 464/179, 183, 902, 157; 29/893.33, 893.34, DIG. 18; 76/107.1, 107.4, 117

[56] References Cited

U.S. PATENT DOCUMENTS

| | | | |
|---|---|---|---|
| 1,802,695 | 4/1931 | Bennett | 464/183 X |
| 2,599,575 | 6/1952 | Morgan | 464/179 |
| 3,024,626 | 3/1962 | Frischman | 464/179 |
| 3,224,243 | 12/1965 | Van Deberg | 72/359 |
| 4,895,700 | 1/1990 | Davidson et al. | 464/902 X |
| 5,184,495 | 2/1993 | Chunn et al. | 72/359 X |
| 5,211,048 | 5/1993 | Takahara et al. | 72/359 X |
| 5,406,825 | 4/1995 | Horie et al. | 72/358 |
| 5,544,548 | 8/1996 | Iihara et al. | 76/107.1 |

FOREIGN PATENT DOCUMENTS

| | | | |
|---|---|---|---|
| 5-212470 | 8/1993 | Japan . | |
| 6-126372 | 5/1994 | Japan . | |
| 1265137 | 3/1972 | United Kingdom | 29/893.34 |

OTHER PUBLICATIONS

Tabor, The Hardness Of Metals, Clarendon Press, pp. 164–165, 1951.

*Primary Examiner*—Anthony Knight
*Attorney, Agent, or Firm*—Oblon, Spivak, McClelland, Maier & Neustadt, P.C.

[57] ABSTRACT

A method for forming a high-tooth spline of a hollow shaft which comprises a step of press-inserting a workpiece of a hollow shaft into a die having a spline-shaped internal surface by a punch, for backing up a portion of the workpiece corresponding to the spline-shaped surface of the die from the inside thereof, having a tip portion made of a material having a hardness lower than that of the die, and a step of forming a spline portion on the workpiece. A hollow shaft having a high-tooth spline formed by the above method.

18 Claims, 10 Drawing Sheets

(A)

(B)

(C)

METHOD FOR FORMING A HIGH-TOOTH SPLINE OF A HOLLOW SHAFT AND HOLLOW SHAFT HAVING A HIGH-TOOTH SPLINE

BACKGROUND OF THE INVENTION

1. Field of the Invention

The present invention relates to a method for forming a high-tooth spline of a hollow shaft in which a punch is used to press-insert a workpiece into a die having a spline-shaped internal surface so as to form a spline portion on the workpiece and in which a mandrel made of a material having a hardness equal to or less than that of the workpiece is disposed at the tip of the punch so as to back up, from the inside, a portion of the workpiece corresponding to the spline-shaped surface of the die, thereby making it possible to form a high-tooth spline on the workpiece.

2. Description of the Prior Art

In a conventional method for forming a spline of a hollow shaft (Japanese Patent Application Laid-Open (kokai) No. 5-212470), as shown in FIG. 10, a punch P is used to press-insert a workpiece W, which is to be formed into a hollow shaft, into a die D having a spline-shaped internal surface DS so as to form a spline portion S on the workpiece W. In this method, a mandrel PM serving as a backup portion integrally formed with the punch P is used to back up, from the inside, a portion of the workpiece W corresponding to the spline-shaped surface DS of the die D.

In the conventional method for forming a spline of a hollow shaft, the mandrel PM integrally formed with the punch P is made of hardened steel, which is the same material as the die D, and therefore has a hardness sufficiently higher than that of the workpiece W, which is to be formed into a hollow shaft. Therefore, during formation of a spline S having a relatively large tooth height with respect to the wall thickness of the workpiece, the hard mandrel PM provides such a large internal restraint that material flow of the workpiece W cannot be guaranteed at a necessary and sufficient level. Accordingly, the conventional method has a problem of difficult formation of a high-tooth spline.

SUMMARY OF THE INVENTION

It is a primary object of the present invention to make it possible to form a high-tooth spline in a hollow shaft.

It is an object to make it practical to form a high-tooth spline in a hollow shaft.

It is another object to make it easy to form precisely a high-tooth spline in a hollow shaft.

It is a further object to increase a limit of high tooth spline formation in a hollow shaft.

It is a still further object to make it possible to transmit a high drive torque of a hollow shaft.

It is a yet further object to make it unnecessary to fit an oil-stopping plug inserted within the hollow shaft.

It is a yet further object to provide a method for forming a high-tooth spline of a hollow shaft and a hollow shaft having a high-tooth spline based on a technical principle in which a workpiece of a hollow shaft is press-inserted into a die having a spline-shaped internal surface by a punch, having a tip portion made of material having a hardness lower than that of the die or the workpiece, for backing up a portion of the workpiece corresponding to the spline-shaped surface of the die.

It is another object to provide a hollow shaft having a high-tooth spline in which a mandrel is inserted at a portion of an inner cylindrical surface of the workpiece corresponding to the high-tooth spline.

It is a further object to provide a method for forming a high-tooth spline of a hollow shaft comprising a step of press-inserting a workpiece of a hollow shaft into a die having a spline-shaped internal surface by a punch, for backing up a portion of the workpiece corresponding to the spline-shaped surface of the die from the inside thereof, having a tip portion made of a material having a hardness lower than that of the die, and a step of forming a spline portion on the workpiece.

It is a still further object to provide a method for forming a high-tooth spline of a hollow shaft wherein the tip portion is made of a material having a hardness not higher than that of the workpiece.

It is a yet further object to provide a method for forming a high-tooth spline of a hollow shaft wherein the workpiece is press-inserted through a tip member as the tip portion provided on a tip end of the punch by the punch.

It is a yet further object to provide a method for forming a high-tooth spline of a hollow shaft wherein the tip member comprises a mandrel of cylindrical body made of a material having a hardness not higher than that of the workpiece.

It is another object to provide a method for forming a high-tooth spline of a hollow shaft wherein the mandrel is made of a material having a hardness equal to or less than 300 in Vickers hardness.

It is a further object to provide a method for forming a high-tooth spline of a hollow shaft wherein a drawing step for drawing the workpiece in a plurality of stages using a die and punch so as to form a smaller diameter portion at one end of the workpiece, before the spline forming step.

It is a still further object to provide a method for forming a high-tooth spline of a hollow shaft wherein a tube expansion step for expanding the other end of the drawn workpiece by using a die and a punch, which is press-inserted into the other end of the workpiece, so as to form a larger diameter portion at the other end of the workpiece.

It is a yet further object to provide a hollow shaft having a high-tooth spline which comprises a hollow shaft body having a spline portion which is formed by press-inserting the hollow shaft body as a workpiece into a die having a spline-shaped internal surface by a punch, for backing up a portion of the hollow shaft body corresponding to the spline-shaped surface of the die from the inside thereof having a mandrel made of material having a hardness lower than that of the die.

In the method according to the first aspect of the present invention which has the above-described feature and which is adapted to form the high-tooth spline of the hollow shaft, the punch is caused to press-insert the workpiece into the die having the spline-shaped internal surface so as to form the spline portion on the workpiece, and the punch has the tip portion made of the material having the hardness lower than that of the die so as to back up, from the inside, the portion of the workpiece corresponding to the spline-shaped surface of the die. In this method, the tip portion of the punch, as well as the workpiece, is deformed in accordance with the spline shape.

In the method according to the second aspect of the present invention which has the above-described feature and which is adapted to form the high-tooth spline of the hollow shaft, the punch is caused to press-insert the workpiece into the die having the spline-shaped internal surface so as to form the spline portion on the workpiece, and the punch is provided at its tip with the mandrel made of the material having the hardness lower than that of the die so as to back up, from the inside, the portion of the workpiece corresponding to the spline-shaped surface of the die. In this method, in addition to the workpiece, the mandrel undergoes plastic deformation in accordance with the spline shape.

In the method according to the third aspect of the present invention which has the above-described feature and which is adapted to form the high-tooth spline of the hollow shaft, the punch is caused to press-insert the workpiece into the die having the spline-shaped internal surface so as to form the spline portion on the workpiece, and the punch is provided at its tip with the mandrel made of the material having the hardness equal to or less than that of the workpiece so as to back up, from the inside, the portion of the workpiece corresponding to the spline-shaped surface of the die. In this method, in addition to the workpiece, the mandrel is easily deformed, through plastic deformation, in accordance with the spline shape.

In the method according to the fourth aspect of the present invention which has the above-described feature and which is adapted to form the high-tooth spline of the hollow shaft, the punch is caused to press-insert the workpiece into the die having the spline-shaped internal surface so as to form the spline portion on the workpiece, and the punch is provided at its tip with the mandrel made of the material having the hardness equal to or less than 300 in Vickers hardness so as to back up, from the inside, the portion of the workpiece corresponding to the spline-shaped surface of the die. In this method, in addition to the workpiece, the mandrel is more easily deformed, through plastic deformation, in accordance with the spline shape.

In the method according to the fifth aspect of the present invention which has the above-described feature and which is adapted to form the high-tooth spline of the hollow shaft, the drawing step and the tube expansion step are performed prior to the spline forming step. In the drawing step, the workpiece is drawn in a plurality of stages using the die and the punch so as to form the smaller diameter portion at one end of the workpiece. In the expansion step, the other end of the workpiece, which has undergone the drawing step, is expanded by using the die and the punch, which is press-inserted into the other end of the workpiece, so as to form the larger diameter portion at the other end of the workpiece. In the spline forming step, the punch is caused to press-insert the workpiece into the die having a spline-shaped internal surface so as to form the spline portion on the workpiece, wherein the punch is provided at its tip with the mandrel made of the material having the hardness equal to or less than 300 in Vickers hardness so as to back up, from the inside, the portion of the workpiece corresponding to the spline-shaped surface of the die. In this method, in addition to the workpiece, the mandrel is more easily deformed, through plastic deformation, in accordance with the spline shape.

In the hollow shaft having the high-tooth spline according to the sixth aspect of the present invention, the high-tooth spline is formed by press-inserting the workpiece into the die having the spline-shaped internal surface by use of the punch, which is provided at its tip with the mandrel made of a material having the hardness lower than that of the die so as to back up, from the inside, the portion of the workpiece corresponding to the spline-shaped surface of the die.

In the method according to the first aspect of the invention that provides the above-described action and that is adapted to form the high-tooth spline of the hollow shaft, since the spline is formed through use of the punch having the tip portion made of the material whose hardness is lower than that of the die, the tip portion of the punch, as well as the workpiece, is deformed in accordance with the spline shape. Accordingly, there is provided an effect of making it possible to form a high-tooth spline, thereby increasing the limit in the formation.

In the method according to the second aspect of the invention that provides the above-described action and that is adapted to form the high-tooth spline of the hollow shaft, since the spline is formed through use of the punch having at its tip the mandrel made of the material whose hardness is lower than that of the die, the mandrel, as well as the workpiece, is subjected to plastic deformation in accordance with the spline shape. Accordingly, there is provided an effect of making it possible to form a high-tooth spline.

In the method according to the third aspect of the present invention that provides the above-described action and that is adapted to form the high-tooth spline of the hollow shaft, since the mandrel made of the material whose hardness is equal to or less than that of the workpiece is used, the mandrel, as well as the workpiece, is easily deformed, through plastic deformation, in accordance with the spline shape. Accordingly, there is provided an effect of making it possible to accurately form a high-tooth spline.

In the method according to the fourth aspect of the present invention that provides the above-described action and that is adapted to form the high-tooth spline of the hollow shaft, since the mandrel made of a material having the hardness equal to or less than 300 in Vickers hardness is used, the mandrel, as well as the workpiece, is more easily deformed, through plastic deformation, in accordance with the spline shape. Accordingly, there is provided an effect of making it possible to more accurately form a high-tooth spline.

In the method according to the fifth aspect of the present invention that provides the above-described action and that is adapted to form a high-tooth spline of the hollow shaft, the workpiece is drawn in a plurality of stages using the die and the punch so as to form the smaller diameter portion at one end of the workpiece, and the other end of the workpiece is expanded in a plurality of stages using the die and a punch that is press-inserted into the other end of the workpiece so as to form the larger diameter portion at the other end of the workpiece. Accordingly, there is provided an effect of making it possible to manufacture a hollow shaft having a precise high-tooth spline and a stepped portion where the diameter varies stepwise.

In the hollow shaft having the high-tooth spline according to the sixth aspect of the present invention that provides the above-described action, since the spline having the large tooth height is formed, there is provided an effect of making it possible to transmit a high torque through the high-tooth spline.

DETAILED DESCRIPTION OF THE PREFERRED EMBODIMENTS

Figure 1:
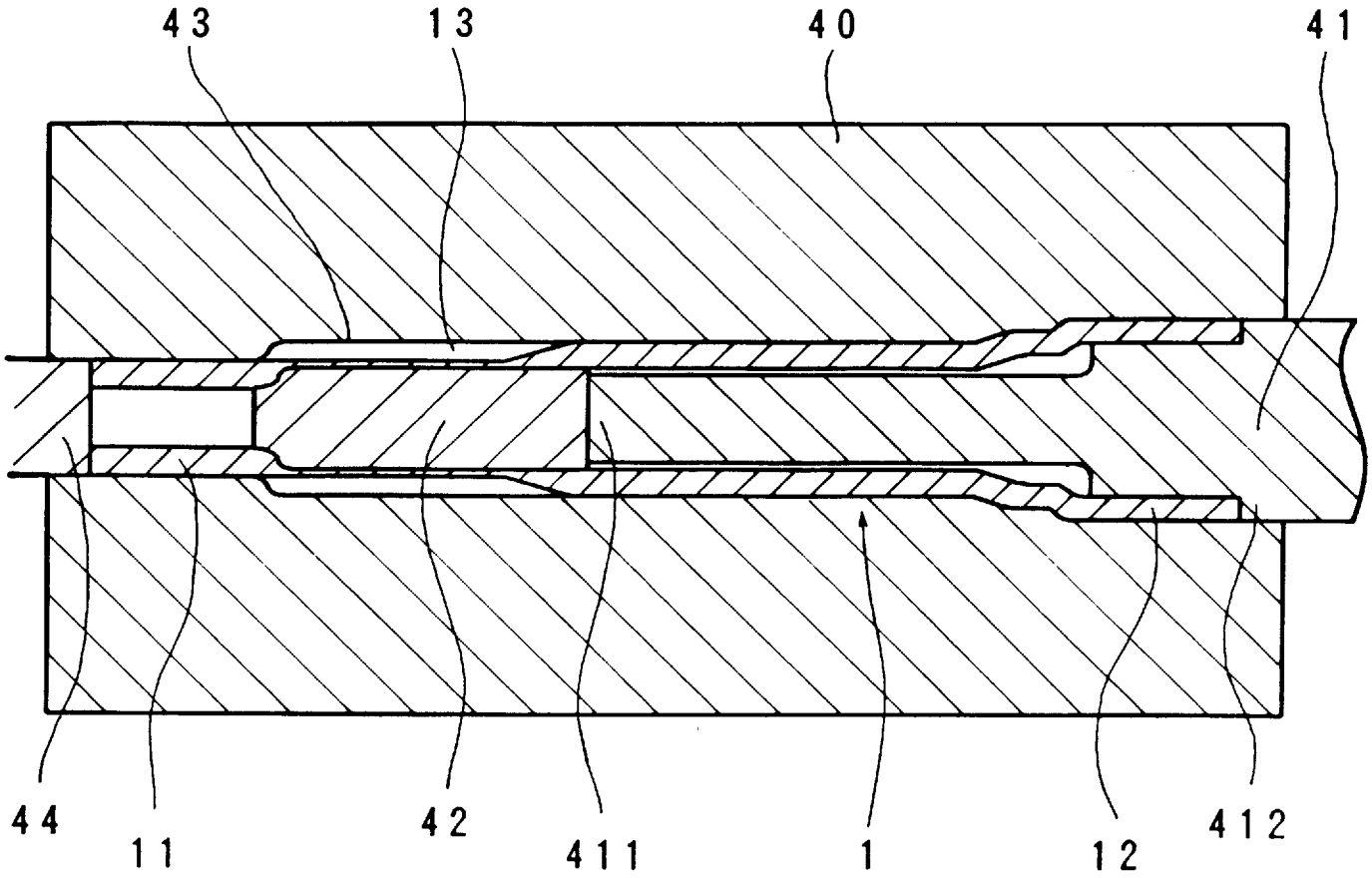
FIG. 1 is a sectional view showing a state in which spline formation is completed in an embodiment of the present invention.

A hollow shaft having a high-tooth spline of the present embodiment is manufactured by a method of the present embodiment which comprises a drawing step, a tube expansion step, and a spline forming step, as shown in FIG. 1 through FIG. 5. In the drawing step, one end of a workpiece 1 is subjected to drawing using a die 20 and a punch 21. In the tube expansion step, the other end of the workpiece 1 is expanded by using a die 30 and a punch 31 which is press-inserted into the other end of the workpiece 1. In the spline forming step, the workpiece 1 is press-inserted into a die 40 having a spline-shaped internal surface by using the punch 41 so as to form a spline portion 13 on the workpiece 1. In this step, a mandrel 42 made of a material having a hardness equal to or less than that of the workpiece 1 and disposed at the tip of the punch 41 is used to back up, from the inside, a portion of the workpiece 1 corresponding to the spline-shaped surface of the die 40.

Figure 6:
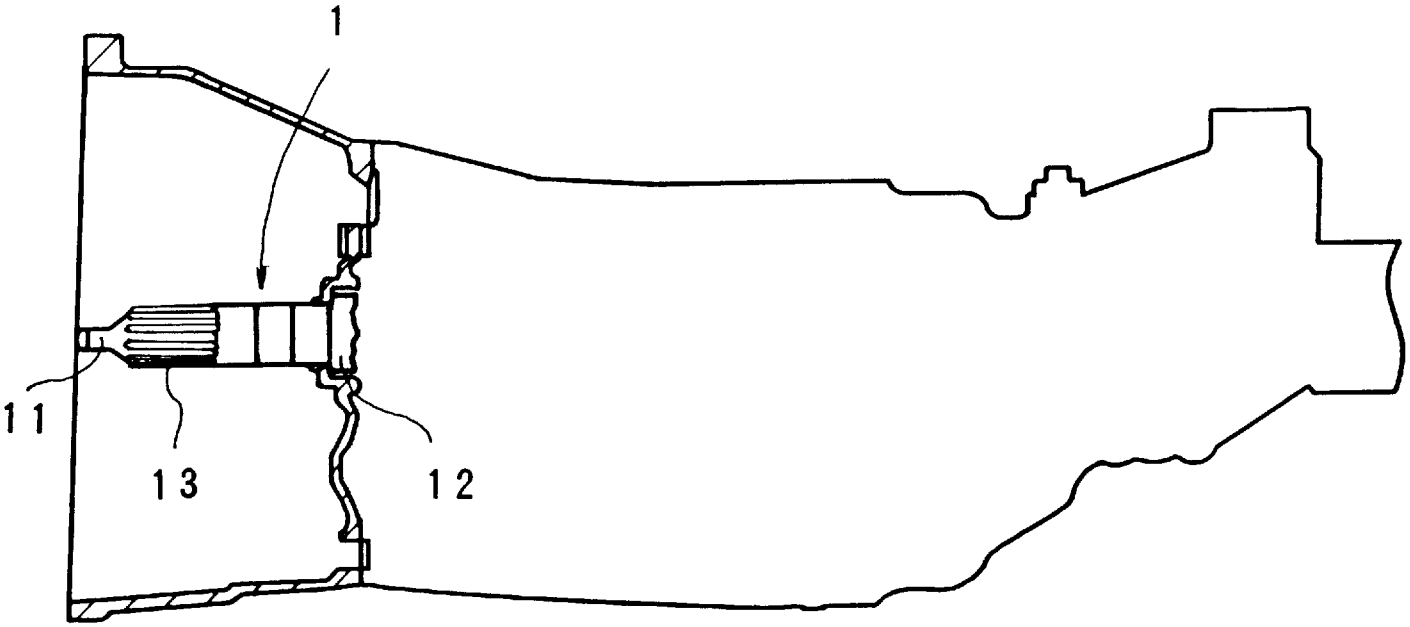
FIG. 6 is a sectional view showing a manual transmission having an input shaft on which a spline was formed by the manufacturing method of the present embodiment.

In the embodiment, the present invention is applied to an input shaft on which is formed a spline portion that is engaged with a clutch disk of a manual transmission, as shown in FIG. 6, as well as to a method of manufacturing such an input shaft.

Figure 7:
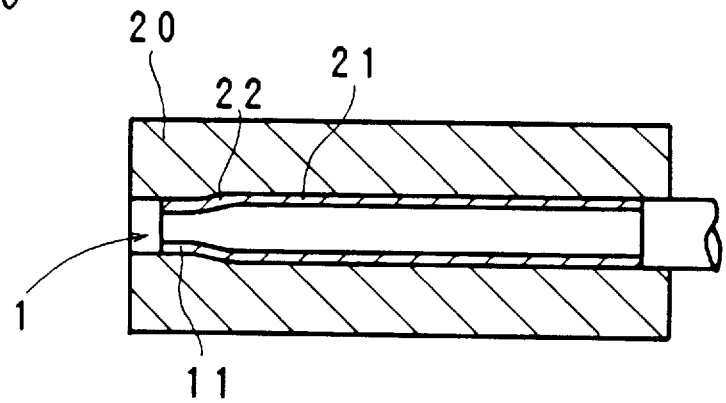
FIGS. 7(A), 7(B), and 7(C) are sectional views showing the respective stages of a drawing step in the present embodiment.
Figure 7:
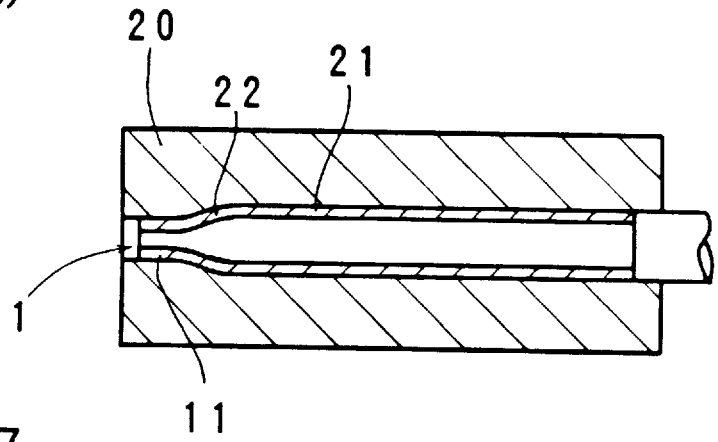
Figure 7:
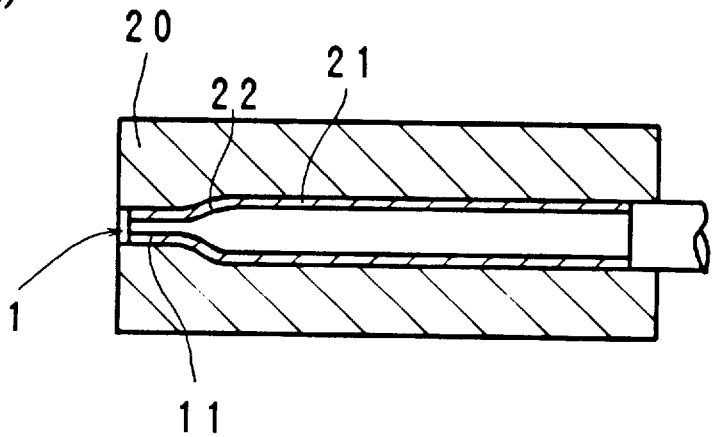

In the drawing step, as shown in FIGS. 7(A)–7(C), a hollow-pipe-shaped piece of raw material (workpiece) having a predetermined outer diameter, inner diameter, and length is press-inserted into the die 20 from the right side thereof using the punch 21. The die 20 has a taper-cone-shaped drawing portion 22 at its left end. The left end of the workpiece 1 is drawn in three stages so that a smaller-diameter drawn portion 11 is formed on the workpiece 1.

The workpiece in the present embodiment is made of alloyed steel or carbon steel. Specifically, chromium steel, chromium-molybdenum steel, nickel-chromium-molybdenum steel, nickel-chromium steel, manganese steel, manganese-chromium steel, or carbon steel is used. More specifically, SCr415–SCr435, SCM415–SCM435, S15C–S50C, SNCM415–SNCM431, etc. (as defined in the Japanese Industrial Standards J(JIS) G 4051, G 4103, G 4104 and G 4105), are used. In the present embodiment, S30C is used as an exemplary material.

Figure 8:
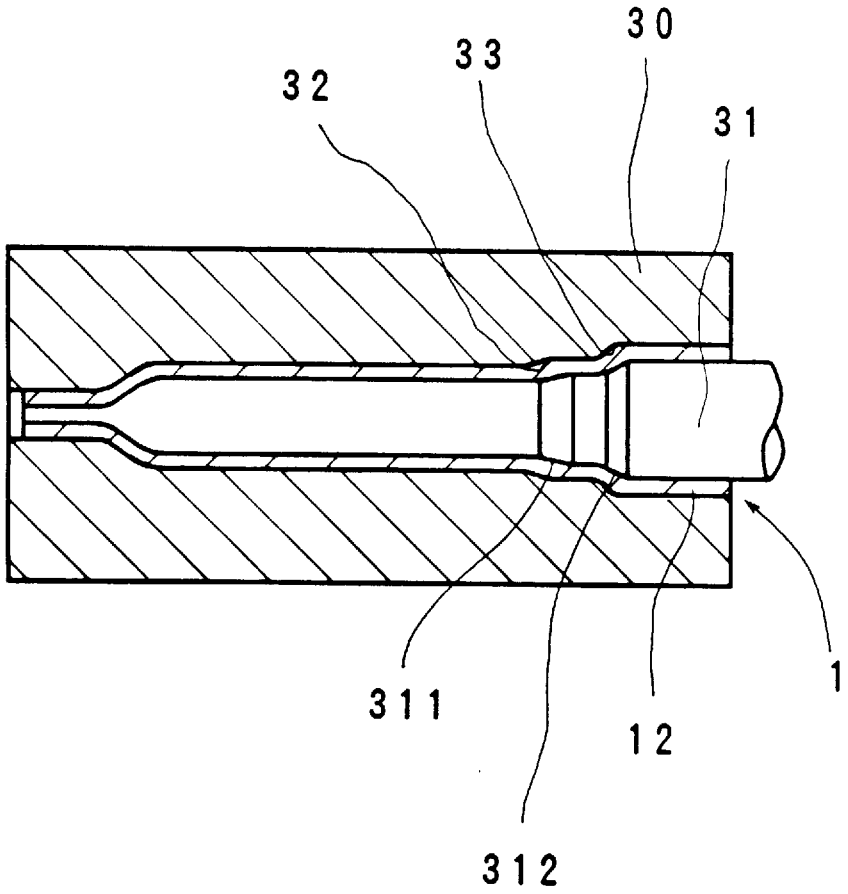
FIG. 8 is a sectional views showing a tube expansion step in the present embodiment.

In the tube expansion step, as shown in FIG. 8, the drawn workpiece (hollow-pipe-shaped piece of raw material) 1, together with a punch 31 having two taper-cone-shaped tube expanding portions 311 and 312, is press-inserted into a die 30 having two taper-cone-shaped drawing portions 32 and 33 at its right end, so as to expand the right end of the workpiece 1, thereby forming a larger diameter portion 12 at the right end of the workpiece 1.

Figure 2:
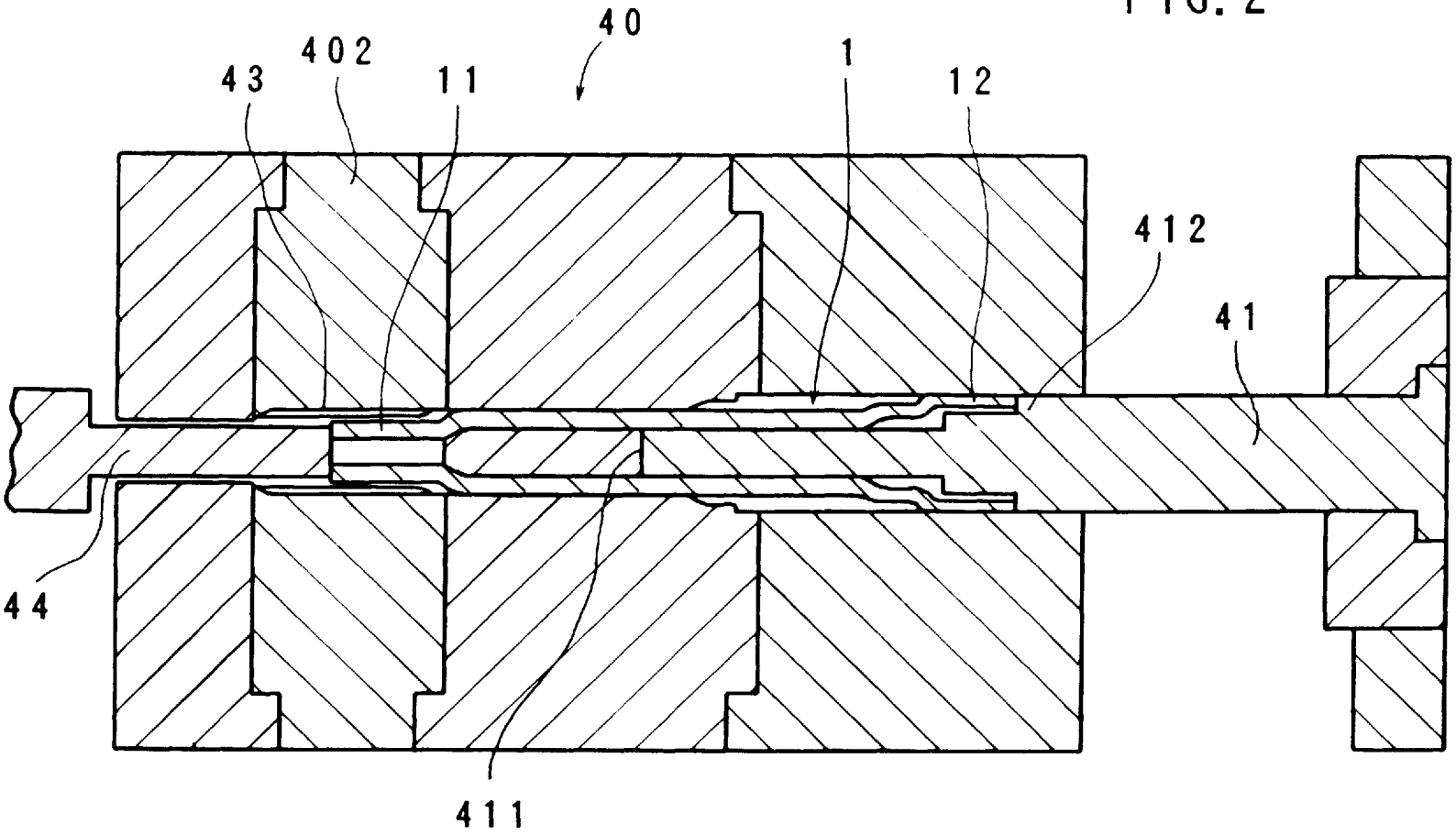
FIG. 2 is a sectional view showing a state before starting the spline formation in the present embodiment.

In the spline forming step, the mandrel 42 is inserted into the workpiece 1 such that the mandrel 42 supports a part of the inner circumferential surface of the workpiece 1 corresponding the spline-shaped surface 43, and the workpiece 1 is pressed leftward by the punch 41, as shown in FIGS. 1 and 2. As a result, the workpiece 1 undergoes plastic working, so that the spline portion 13 is formed.

The mandrel 42 is made of a material, such as alloyed steel, carbon steel, copper, or aluminum, which has a hardness equal to or less than 300 in Vickers hardness. From the viewpoint of cost, it is preferred that SS material which is the same material of the workpiece 1 or carbon steel of S10C–S35C be used.

Figure 3:
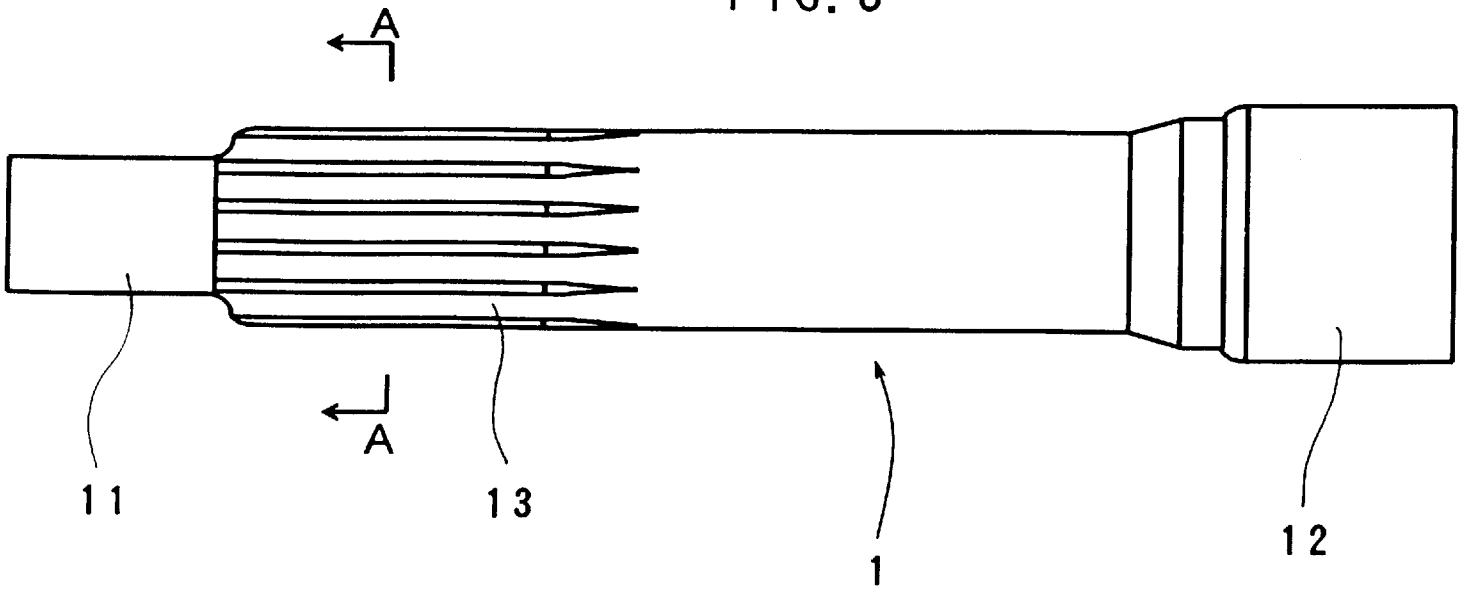
FIG. 3 is a side view showing a workpiece on which a spline was formed by the manufacturing method of the present embodiment.
Figure 4:
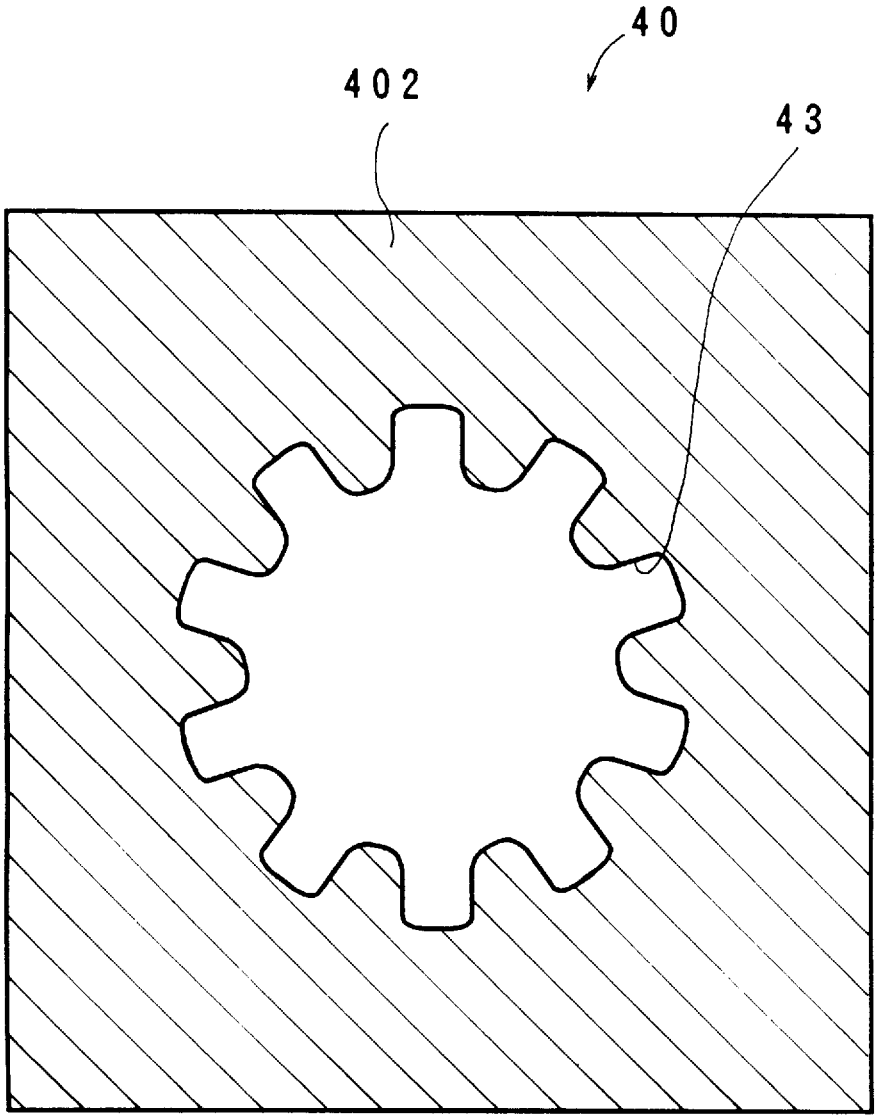
FIG. 4 is a sectional view showing a die used in the manufacturing method of the present embodiment.
Figure 5:
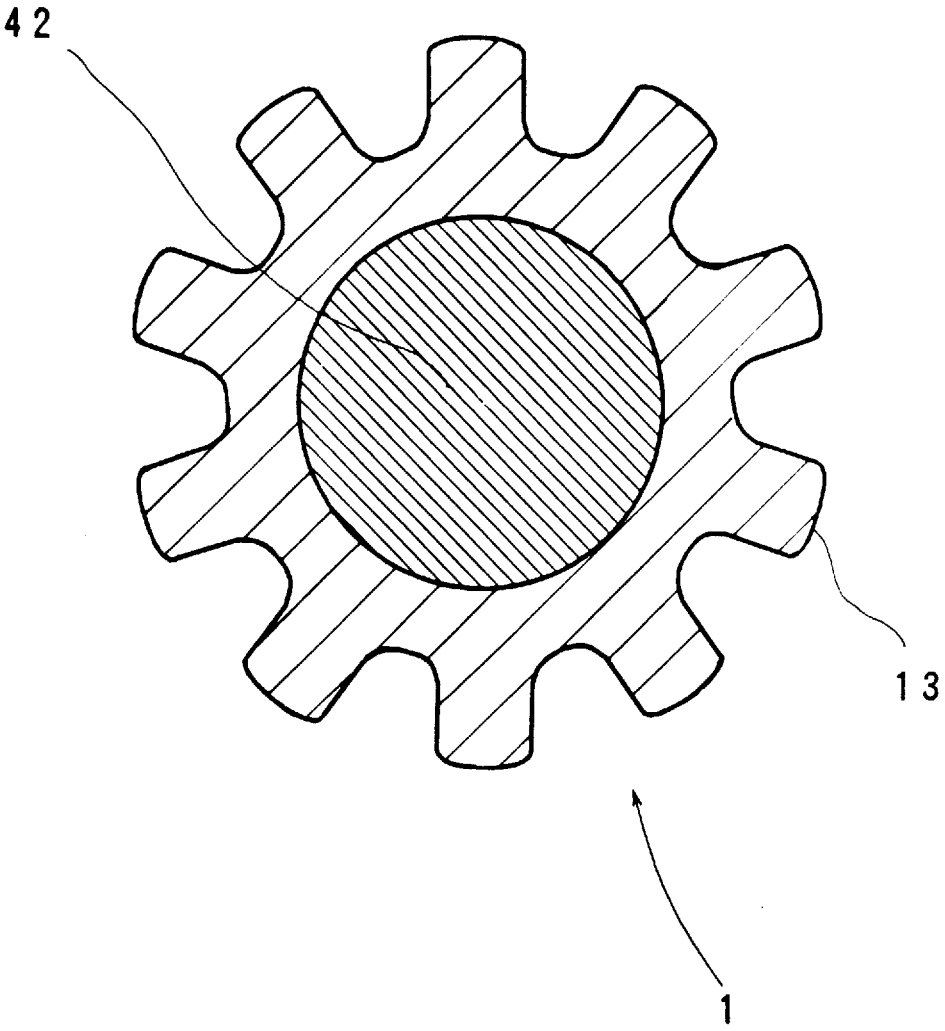
FIG. 5 is a sectional view showing a workpiece on which a spline was formed in a state the workpiece was backed up by a mandrel in accordance with the manufacturing method of the present embodiment.

In the spline forming step, the portion of the workpiece 1 corresponding to the spline-shaped surface 43 is backed up by the mandrel 42 from the inside of the workpiece 1 toward the die 40, which has a spline-shaped surface 43 at the left end of the central portion of the inner circumferential surface. In this state, the punch 41, whose left end contacts the right end of the mandrel 42, is caused to press the workpiece 1 leftward in FIGS. 1 and 2 against a knock-out punch 44, which contacts the left end of the workpiece 1. As a result, the spline portion 13 shown in FIG. 3 is formed through plastic working.

As shown in FIG. 2, the die 40 having the spline-shaped surface 43 is divided into four elements in the axial direction, and the four elements can be disengageably engaged. The above-described spline-shaped surface 43 is formed by the inner circumferential surface of a spline die 402 that constitutes the second element.

The shape of the spline-shaped surface 43 formed by the inner circumferential surface of the spline die 402 is determined such that the difference between the crest diameter and the root diameter is larger than in the normal case, thereby making it possible to form a high-tooth spline on the outer circumferential surface of the hollow shaft; i.e., the workpiece 1.

As shown in FIG. 1, the punch 41 for pressing the workpiece 1 has a tip portion having a substantially T-shaped vertical cross section. A front projecting portion 411 of the punch 41 is brought into contact with the right end of the mandrel 42, and a shoulder portion 412 of the punch 41 is brought into contact with the right end of the larger diameter portion 12 of the workpiece 1 that has undergone the tube expansion. Subsequently, the punch 41 is caused to press the workpiece 1 leftward for plastic working, thereby forming the spline portion 13.

The method for forming a high-tooth spline of a hollow shaft in the present invention has the following features. In the drawing step, as shown in FIGS. 7(A)–7(C), a hollow-pipe-shaped piece of raw material (workpiece) having a predetermined outer diameter, inner diameter, and length is press-inserted into the die 20 from the right side thereof by using the punch 21. The die 20 has the taper-cone-shaped drawing portion 22 at its left end. The left end of the workpiece 1 is drawn in three stages, so that the smaller-diameter drawn portion 11 is formed on the workpiece 1.

In the tube expansion step, as shown in FIG. 8, the drawn workpiece (hollow-pipe-shaped piece of raw material) 1 is press-inserted into the die 30 having two taper-cone-shaped drawing portions 33 at its right end, together with the punch 31 having two taper-cone-shaped tube expanding portions 311 and 312, so as to expand the right end of the workpiece 1 in a plurality of stages, thereby forming the larger diameter portion 12 at the right end of the workpiece.

In the spline forming step, as shown in FIGS. 1 and 2, the portion of the workpiece 1 corresponding to the spline-shaped surface is backed up by the mandrel 42 from the inside of the workpiece 1 toward the die 40, which has a spline-shaped surface 41 at the left end of the central portion of the inner circumferential surface. In this state, the punch 41, whose left end contacts the right end of the mandrel 42, is caused to press the workpiece 1 leftward in FIGS. 1 and 2 against the knock-out punch 43 shown in FIG. 2, which contacts the left end of the workpiece. As a result, the material of the mandrel 42, as well as the material of the workpiece 1, flows, so that plastic working is performed so as to form the spline portion 13.

The hollow shaft having a high-tooth spline which is formed by the above-described manufacturing method is an input shaft on which is formed a spline portion that is engaged with a clutch disk of a manual transmission, as shown in FIGS. 3 and 6. The input shaft serves to transmit drive torque from an engine to the manual transmission through the high-tooth spline.

In the method of the present embodiment that is adapted to form a high-tooth spline of a hollow shaft and that provides the above-described action, since the spline 13 is formed through use of the punch 41, which has at its tip the mandrel 42 made of a material whose hardness is sufficiently lower than that of the die 40, the mandrel 42, as well as the workpiece 1, is subjected to plastic deformation in accordance with the spline shape. Accordingly, there is provided an effect of making it possible to form a high-tooth spline, thereby increasing the limit in spline formation.

In the method of the present embodiment that is adapted to form a high-tooth spline of a hollow shaft, through use of the punch 41 having at its tip the mandrel 42 made of a material whose hardness is not higher than that of the workpiece 1, the spline portion 13 is formed in a state in which the internal restraint by the mandrel 1 is decreased, so that the material of the mandrel 42, as well as the material of the workpiece 1, easily flows for plastic deformation. Accordingly, there is provided an effect of making it possible to accurately form a high-tooth spline.

In the method of the present embodiment that is adapted to form a high-tooth spline of a hollow shaft, since the mandrel 42 made of a material having a hardness equal to or less than 300 in Vickers hardness is used, the material of the mandrel 42, as well as the material of the workpiece 1, flows in the axial direction more easily. In addition, a proper degree of compressive force is applied axially to the mandrel 42 by the tip end of the punch 41 so as to cause plastic deformation while controlling the axial extension of the material of the mandrel 42. Accordingly, there is provided an effect of making it possible to prevent the workpiece 1 from sinking with respect to the die 40, thereby forming a high-tooth spline in a more accurate manner.

In the method of the present embodiment that is adapted to form a high-tooth spline of a hollow shaft, the workpiece 1 is drawn in a plurality of stages using the die 20 and the punch 21 so as to form the smaller diameter portion 11 at the left end of the workpiece, and the right end of the workpiece 1 is expanded in a plurality of stages using the die 30 and the punch 31 that is press-inserted into the right end of the workpiece 1 so as to form the larger diameter portion 12 at the right end of the workpiece. Accordingly, there is provided an effect of making it possible to manufacture a hollow shaft having a precise high-tooth spline and a stepped portion where the diameter varies stepwise, such as an input shaft on which is formed a spline portion that is engaged with a clutch disk of a manual transmission.

Figure 9:
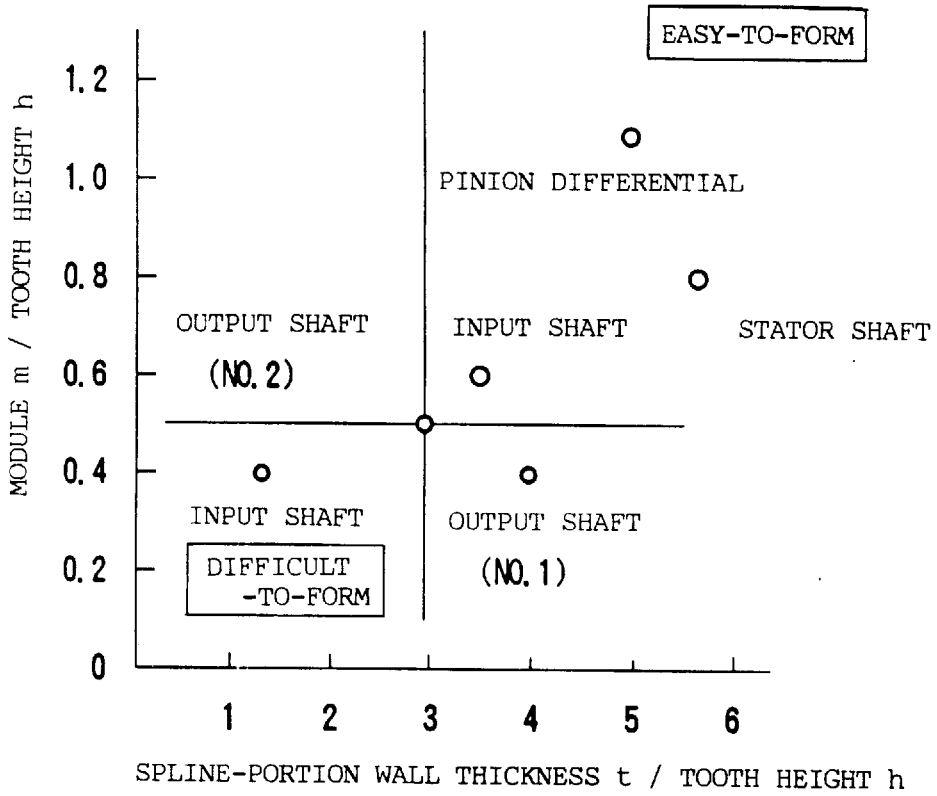
FIG. 9 is a graph showing the relationship between products to be worked and the degree of difficulty of formation.
Figure 10:
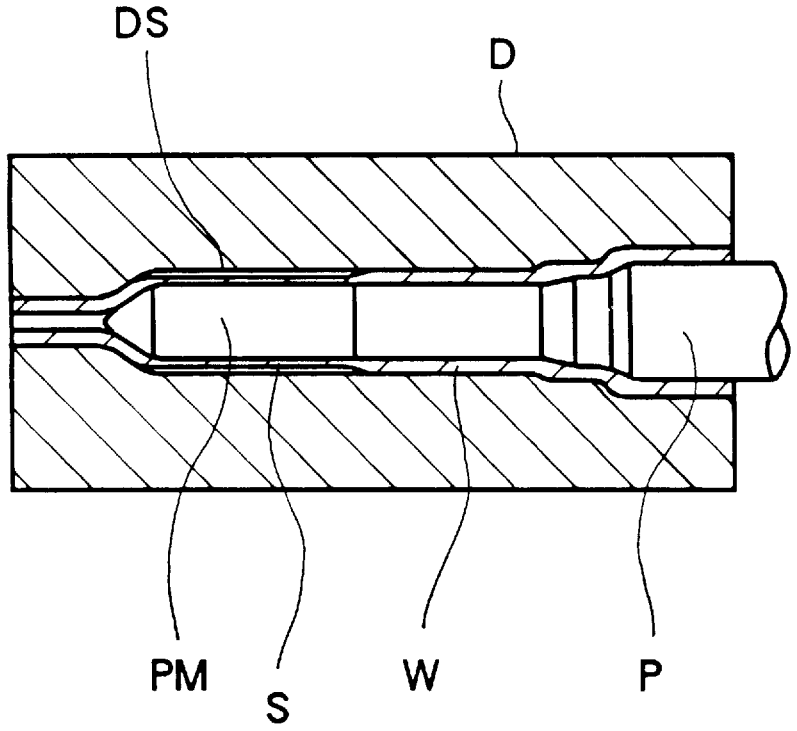
FIG. 10 is a sectional view showing a spline forming step in a conventional manufacturing method.

That is, it makes it possible to form the above-described input shaft, which has conventionally been considered difficult to form because the spline of the input shaft falls in the difficult-to-form area shown in FIG. 9, wherein the ratio of spline-portion wall thickness to tooth height is equal to or less than 3 and the ratio of module to tooth height is equal to or less than 0.5. In addition, the limit of spline formation is increased.

In the hollow shaft having a high-tooth spline according to the present embodiment, since the spline 13 having a large tooth height is formed, the hollow shaft can transmit a higher torque through the high-tooth spline. Accordingly, there is provided an effect of making it possible to transmit a high drive torque from an engine to a manual transmission via the high-tooth spline.

In the hollow shaft having a high-tooth spline according to the present embodiment, since the mandrel 42 is integrally formed and held within the hollow shaft 1, there is provided an effect of making it unnecessary to fit an oil-stopping plug within the hollow shaft 1.

In the above-described embodiment, a description is given of an example in which the mandrel that contacts the tip of the punch and that is pressed by the punch is integrally formed and held within the hollow shaft. However, the present invention is not limited thereto. For example, an elastic member made of a material, such as urethane rubber or any other synthetic resin, whose hardness is sufficiently lower than that of the die and which is elastically deformable, may be integrally formed at the tip of the punch. In such a case, when a workpiece is press-inserted into the die by using the punch, a spline is formed on the workpiece, and the tip portion of the punch, as well as the workpiece, is elastically deformed in accordance with the spline shape. When the punch is retracted, the tip portion of the punch is also retracted, so that a high-tooth spline is formed on the hollow shaft while an axially extending bore is left at the center of the workpiece 1. This makes it possible to recycle the mandrel which is inserted into products.

In the above-described embodiment, a description is given of an input shaft on which is formed a spline portion that is engaged with a clutch disk of a manual transmission. However, the present invention is not limited thereto, and can be applied to other hollow shafts which are required to have high-tooth splines and to have high-tooth spline-shaped gear.

The present invention can be applied to a hollow shaft and method for forming a high-tooth spline of a hollow shaft in which the ratio of a tooth height of the spline portion to an original wall thickness of the workpiece before forming the spline portion is more than 0.3.

What is claimed is:

1. A method for forming a high-tooth spline of a hollow shaft comprising:

a step of press-inserting a workpiece of a hollow shaft into a die having a spline-shaped internal surface using a punch which backs up a portion of said workpiece corresponding to said spline-shaped surface of said die from the inside thereof, the punch having a tip portion made of a material having a hardness lower than that of said die, and a step of forming a spline portion on said workpiece.

2. A method for forming a high-tooth spline of a hollow shaft according to claim 1, wherein said tip portion is made of a material having a hardness not higher than that of said workpiece.

3. A method for forming a high-tooth spline of a hollow shaft according to claim 2, wherein said workpiece is press-inserted through a tip member as said tip portion provided on a tip end of said punch by said punch.

4. A method for forming a high-tooth spline of a hollow shaft according to claim 3, wherein said tip member comprises a mandrel of cylindrical body made of a material having a hardness not higher than that of said workpiece.

5. A method for forming a high-tooth spline of a hollow shaft according to claim 4, wherein said mandrel is made of a material having a hardness equal to or less than 300 in Vickers hardness.

6. A method for forming a high-tooth spline of a hollow shaft according to claim 4, wherein a drawing step for drawing said workpiece in a plurality of stages using a die and punch so as to form a smaller diameter portion at one end of said workpiece, before said spline forming step.

7. A method for forming a high-tooth spline of a hollow shaft according to claim 6, wherein a tube expansion step for expanding the other end of said drawn workpiece by using a die and a punch, which is press-inserted into the other end of said workpiece, so as to form a larger diameter portion at the other end of said workpiece.

8. A method for forming a high-tooth spline of a hollow shaft according to claim 6, wherein said drawing die has a taper-cone-shaped drawing portion at on axial end thereof, in order to draw said workpiece at plurality of stages.

9. A method for forming a high-tooth spline of a hollow shaft according to claim 7, wherein said expanding die has two taper-cone-shaped drawing portions at another axial end thereof.

10. A method for forming a high-tooth spline of a hollow shaft according to claim 4, wherein said press-inserting die comprises at least two die elements divided in the axial direction and disengageably engaged each other.

11. A method for forming a high-tooth spline of a hollow shaft according to claim 4, wherein the ratio of sline-portion wall thickness to tooth height of said workpiece is equal to or less than 3, and the ratio of module to tooth height thereof is equal to or less than 0.5.

12. A hollow shaft having a high-tooth spline comprising:

a hollow shaft body having a spline portion which is formed by press-inserting said hollow shaft body as a workpiece into a die having a spline-shaped internal surface using a punch which backs up a portion of said hollow shaft body corresponding to said spline-shaped surface of said die from the inside thereof, the punch having a mandrel made of material having a hardness lower than that of said die.

13. A hollow shaft having a high-tooth spline according to claim 12, wherein said mandrel is made of a material having a hardness not higher than that of said hollow shaft body.

14. A hollow shaft having a high-tooth spline according to claim 13, wherein said hollow shaft body is made of alloyed steel or carbon steel.

15. A hollow shaft having a high-tooth spline according to claim 14, wherein said alloyed steel is one selected from the group consisting of chromium steel, nickel-chromium steel, maganese steel, nickel-chromium-molybdenum steel, nickel-chromium steel, maganese steel, or maganese-chromium steel.

16. A hollow shaft having a high-tooth spline according to claim 15, wherein said alloyed steel is one selected from the group consisting of SCr415–SCr435, SCM415–SCM435, S15C–S50C, or SNCM415–SNCM431.

17. A hollow shaft having a high-tooth spline according to claim 14, wherein said mandrel is made of one selected from the group consisting of alloyed steel, carbon steel, copper, or aluminum which has a hardness equal to or less than 300 in Vickers hardness.

18. A hollow shaft having a high-tooth spline according to claim 12, whererin the ratio of a tooth height of said spline portion to an original wall thickness of said workpiece before forming said spline portion is more than 0.3.

* * * * *